US010219619B1

(12) United States Patent
Smith

(10) Patent No.: US 10,219,619 B1
(45) Date of Patent: Mar. 5, 2019

(54) HANGING RACK WITH LOCKABLE LATCHES

(71) Applicant: Chad H. Smith, Parkersburg, WV (US)

(72) Inventor: Chad H. Smith, Parkersburg, WV (US)

( * ) Notice: Subject to any disclaimer, the term of this patent is extended or adjusted under 35 U.S.C. 154(b) by 0 days.

(21) Appl. No.: 15/695,127

(22) Filed: Sep. 5, 2017

(51) Int. Cl.

| | |
|---|---|
| ***A47F 5/08*** | (2006.01) |
| ***A47B 61/00*** | (2006.01) |
| ***A47B 95/00*** | (2006.01) |
| ***E05B 67/38*** | (2006.01) |
| ***E05B 69/00*** | (2006.01) |
| ***E05B 73/00*** | (2006.01) |

(52) U.S. Cl.
CPC ..... *A47B 61/003* (2013.01); *A47B 95/008* (2013.01); *A47F 5/08* (2013.01); *E05B 67/383* (2013.01); *E05B 69/006* (2013.01); *E05B 73/00* (2013.01)

(58) Field of Classification Search
CPC ... A47B 61/003; A47B 95/008; E05B 67/383; E05B 73/00; E05B 69/006; E05B 69/02; E05B 69/00; E05B 67/38; E05B 73/02; E05B 73/0041; E05B 73/0017; E05B 73/0047; E05B 73/0064; A47G 25/06; A47F 5/08
USPC ..... 211/4, 7, 8, 85.3, 87.01; 70/14, 18, 19, 70/57, 58–62
See application file for complete search history.

(56) References Cited

U.S. PATENT DOCUMENTS 323,397 A * 8/1885 Carter ..... E05B 73/02 211/62
428,814 A * 5/1890 Morse ..... E05B 73/02 211/62
438,735 A * 10/1890 Miller et al. ..... A63C 11/025 211/4
499,974 A * 6/1893 Egberts ..... E05B 73/02 211/63
678,694 A * 7/1901 Schaller ..... E05B 73/02 211/9
697,781 A * 4/1902 Barton et al. ..... E05B 69/006 211/8
727,056 A * 5/1903 Backus ..... E05B 73/02 211/9
733,963 A * 7/1903 Hinman ..... E05B 73/02 15/237

(Continued)

FOREIGN PATENT DOCUMENTS

DE 102008006023 A1 8/2009

OTHER PUBLICATIONS

Lockable wardrobe holder for holding e.g. coat, on wall in public space, has closure part, in which wardrobe part is fixed by pressing operation in suspended manner, where part is perpendicularly fastened with threaded and/or wood screw. Patent translation [online]. Google Patents, [retrieved on Oct. 5, 2016]. Retrieved from the Internet: <URL: https://patents.google.com/patent/DE102008006023A1/en?oq=lockable+jacket+rack>.

*Primary Examiner* — Jennifer E. Novosad

(74) *Attorney, Agent, or Firm* — Cramer Patent & Design, PLLC; Aaron R. Cramer

(57) ABSTRACT

A hanging safety harness rack having a plurality of latches for holding individual safety harnesses. Each latch includes an individual locking feature which locks its safety harness in place. Also included is a shared locking feature that preventing all latches from opening and thus locking all safety harnesses in place.

16 Claims, 4 Drawing Sheets

(56) References Cited

U.S. PATENT DOCUMENTS 747,398 A * 12/1903 Fields ..... E05B 69/006 211/8
941,779 A * 11/1909 Hodgkins ..... E05B 69/006 211/60.1
971,977 A * 10/1910 Detzner ..... E05B 69/006 211/8
979,990 A * 12/1910 Murphy ..... E05B 69/006 211/8
1,045,436 A * 11/1912 Quinllan ..... E05B 73/02 211/9
1,120,542 A * 12/1914 Rogers ..... E05B 69/006 211/8
1,175,715 A * 3/1916 Covatsh ..... E05B 69/006 211/8
1,204,813 A * 11/1916 Murray ..... E05B 69/006 211/4
1,221,584 A * 4/1917 Patrick ..... E05B 69/006 211/60.1
1,225,150 A * 5/1917 McGuire ..... E05B 69/006 211/8
1,228,631 A * 6/1917 Wolfe ..... E05B 73/02 211/9
1,291,430 A * 1/1919 Davenport ..... E05B 69/006 206/565
1,368,711 A * 2/1921 Foley ..... E05C 1/04 292/148
1,428,810 A * 9/1922 Shoemaker ..... A47G 25/12 70/59
1,714,087 A 5/1929 Goldhardt
1,806,660 A * 5/1931 Backus ..... E05B 73/02 70/59
2,791,335 A * 5/1957 Leebow ..... A47G 25/18 174/146
2,946,452 A * 7/1960 Caloiero ..... A47B 81/005 211/4
3,022,895 A 2/1962 Kingsley
3,438,506 A * 4/1969 Groth ..... A47F 5/01 211/4
3,567,034 A * 3/1971 Mozelsio ..... A47G 25/0692 211/7
3,785,501 A * 1/1974 Canning ..... A47F 5/0861 211/57.1
3,966,100 A * 6/1976 Nelson ..... A47G 25/32 211/4
4,027,798 A * 6/1977 Swaim ..... A01K 97/08 211/4
4,036,366 A * 7/1977 Dixon ..... A22C 15/007 211/124
4,113,107 A * 9/1978 Jaeger ..... A47B 81/005 211/4
4,155,458 A * 5/1979 Moline ..... B25H 3/04 211/4
4,248,399 A * 2/1981 Gipson ..... B60C 27/00 211/4
4,265,380 A * 5/1981 Webster ..... E05B 69/006 223/85
4,286,444 A * 9/1981 Grudich ..... A01D 34/001 70/13
4,336,885 A * 6/1982 Thomas ..... A47F 7/024 211/4
4,462,497 A * 7/1984 Maule ..... A47F 5/04 211/59.1
4,756,504 A 7/1988 Chamberlain
4,956,982 A * 9/1990 Valley ..... E05B 67/383 70/18
5,154,072 A * 10/1992 Leyden ..... E05B 69/006 211/4
5,160,048 A * 11/1992 Leyden ..... A47F 7/24 211/7
5,407,170 A * 4/1995 Slivon ..... B25H 3/06 211/7
5,419,165 A * 5/1995 Perkins ..... E05B 67/383 292/258
5,493,879 A * 2/1996 Bison ..... E05B 69/006 211/7
5,520,291 A * 5/1996 Graham ..... A47B 81/005 211/4
5,647,489 A * 7/1997 Bellis, Jr. ..... A47B 81/005 211/208
5,823,358 A * 10/1998 Leyden ..... A47F 5/0861 211/8
5,868,015 A * 2/1999 Eaker ..... E05B 67/383 292/148
6,003,685 A * 12/1999 Malin ..... A47F 5/0861 211/59.1
6,173,842 B1 * 1/2001 Fitzgerald ..... B60R 9/00 211/4
6,223,915 B1 * 5/2001 Waner ..... A47F 7/19 211/124
6,427,497 B1 * 8/2002 Mossberg ..... A47B 81/005 211/4
6,767,234 B1 * 7/2004 Rosa ..... A47F 5/0823 211/1.55
6,932,224 B1 * 8/2005 Sandberg ..... A47B 81/005 211/70.8
7,137,513 B2 * 11/2006 Sedon ..... A47F 5/0861 211/59.1
7,219,464 B1 * 5/2007 Kujawa ..... A01K 97/08 211/70.8
7,475,575 B1 * 1/2009 Greenfield ..... E05B 73/00 211/4
7,628,281 B2 * 12/2009 Sopel ..... B60P 7/15 211/7
7,780,385 B2 * 8/2010 Brierton ..... B60P 7/135 248/221.11
7,891,614 B2 2/2011 Czajor
8,387,808 B2 * 3/2013 Radowski ..... A47G 25/1464 211/123
8,800,785 B2 * 8/2014 Kalafut ..... A47F 5/0861 211/103
9,404,290 B2 * 8/2016 Leyden ..... E05B 73/0017
9,702,169 B2 * 7/2017 McNeil ..... E05B 67/383
9,717,358 B2 * 8/2017 Davis ..... A47G 25/746
9,737,144 B1 * 8/2017 Brown ..... A47F 5/08
9,834,960 B2 * 12/2017 Chesterton ..... E05B 73/0094
2004/0155000 A1 * 8/2004 Mele ..... A47F 7/0028 211/4
2004/0262247 A1 * 12/2004 Moon ..... A47F 3/002 211/74
2005/0205505 A1 * 9/2005 Manabe ..... A47G 25/12 211/61
2007/0057001 A1 * 3/2007 Wang ..... B60R 9/06 224/536
2007/0210021 A1 * 9/2007 Whitehead ..... B25H 3/04 211/70.6
2008/0078727 A1 * 4/2008 Sargent ..... B60P 3/14 211/4
2009/0193631 A1 * 8/2009 Liu ..... A45C 13/18 24/458
2010/0148523 A1 * 6/2010 Tai ..... E05B 17/2038 292/236
2012/0138548 A1 * 6/2012 Young ..... A63C 11/007 211/4
2015/0076094 A1 * 3/2015 Allahverdian ..... A47G 25/743 211/105.1
2016/0000993 A1 * 1/2016 Endyk ..... A61M 5/008 211/85.13
2016/0015190 A1 * 1/2016 White ..... A47F 7/24 211/113
2016/0051046 A1 * 2/2016 Sassman ..... F16B 11/006 211/85.6
2016/0167748 A1 * 6/2016 Dias ..... B63B 35/7946 211/85.7

* cited by examiner

HANGING RACK WITH LOCKABLE LATCHES

RELATED APPLICATIONS

Not applicable.

FIELD OF THE INVENTION

The presently disclosed subject matter is directed to hanging clothes racks. More particularly, it is directed to hanging racks for safety harnesses which include individual and shared locking features that prevent unauthorized removal of the safety harnesses.

BACKGROUND OF THE INVENTION

Clothes racks are very common features that are often found in stores, homes, businesses, schools, churches, and just about everywhere people congregate. The purpose of a clothes rack is to hold garments, such as overcoats, sweaters, scarves, hats and other clothing when they are not being worn. Clothes racks have proven to be highly useful and beneficial and as such are very widely accepted.

While clothes racks are very successful some attire is just not well-suited to the common clothes rack, for example, safety harnesses. By their nature safety harnesses are important devices that should be securely hung in a manner that protects them while also preventing them from being inadvertently removed. This is critical because when a safety harness is needed it must be available to help protect the wearer and possibly others from harm.

Safety harnesses are not particularly well-suited for storing on a common clothing rack. For example, safety harness may have oddly shaped straps, may be imbalanced, may have one (1) or more external features that might get in the way if hung on a normal clothing rack, and may have large gaps. Thus, most safety harnesses are either stored flat or they are hung by one (1) of the few common features found on most safety harnesses, a safety harness ring.

A safety harness ring is usually an "O"-shaped or a "D"-shaped ring that is used as a connection point for various straps, buckles, braces and other features of the safety harness. As such a safety harness rings tend to be centrally located and physically strong. Usually made of metal, a safety harness ring is difficult to twist, cut, break, and/or split. Thus, safety harness rings have been hung on hooks or other features to vertically retain safety harnesses on walls and other structures.

However, safety harnesses that are just hung by their safety harness rings are subject to being inadvertently moved, borrowed, stolen, or otherwise misplaced. Various types of securing mechanisms have been used for safety harnesses to help ensure that they are available when needed. While somewhat successful, prior art attempts at securing safety harnesses tend to have usability problems. First, in places such as fire departments, police stations, military installations, and logging companies it is highly desirable to lock all safety harnesses at the same time. That enables such facilities to visually and easily count and account for all of their safety harnesses. If one (1) is missing it is readily apparent.

Another problem with prior art devices for securing safety harnesses is that it is often highly desirable to be able to individually lock safety harness. That way if a "wearer" is not present that wearer can be assured that his safety harness is protected. In addition a given wearer may own his own safety harness, which may represent a relatively large economic asset and which may be needed in his profession. The owner would want to ensure that his safety harness is protected.

Accordingly, there exists a need for safety harness racks that can individually secure safety harnesses while also enabling multiple safety harnesses to be secured. Ideally a safety harness rack would be easy to use and highly effective. Preferably such a safety harness rack would lock a safety harness by locking its safety harness ring in place. Even more preferably such a safety harness rack would vertically secure safety harnesses. Ideally such a safety harness rack would be suitable for being supplied at low cost.

SUMMARY OF THE INVENTION

The principles of the present invention provide for an improved a safety harness rack that can individually secure safety harnesses while also enabling multiple safety harnesses to be secured as a group. Such a safety harness rack locks safety harness rings in place so as to vertically retain the safety harnesses. The safety harness rack is easy to use and is suitable for being supplied at low cost.

A harness rack that is in accord with the present invention includes an elongated base member having a front, a first side, and a second side. The harness rack includes a first latch that is attached to the base member and which is configured to hold a first ring. That first latch has a first individual locking feature for selectively preventing only the first latch from opening. The harness rack further includes a second latch that is attached to the base member for holding a second ring. The second latch has a second individual locking feature for selectively preventing only the second latch from opening. Also included is a shared locking feature that extends from the base member for selectively preventing both the first latch and the second latch from opening.

In practice, the shared locking feature extends from both the first side and the second side and the first ring is beneficially an "O" shaped-ring attachment to a safety harness. The first latch includes a mounting bracket having a flat bottom that is connected to the base member, and two (2) arms that extend perpendicularly from the flat bottom. The two arms may form a gap and the two (2) arms may also form a "V"-shaped opening that extends from a circular opening. Beneficially, there is a catch that is located in the gap for capturing the first ring and for retaining the first ring in the circular opening. Also included is a pivot that is preferably located behind the circular opening and which is attached to the catch. The pivot enables the catch to pivot open to enable the first ring to enter into the circular opening by passing through the "V"-shaped opening. In practice, the catch has a lever for enabling a user to pivot the catch open. Ideally the lever is configured to bias the catch closed. The catch also includes a hook that captures the first ring and retains it in the circular opening. The catch further includes a lock hole for receiving a locking mechanism that when inserted through the lock hole prevents the catch from opening.

The shared locking feature may include a first vertically orientated extension member that is attached to the first side and which forms a first vertical guide, and a crossbar that moves along the first vertical guide between an open position wherein the crossbar allows the first latch and the second latch to open and a closed position wherein the crossbar prevents the first latch and the second latch from opening. The first vertical guide is beneficially formed by sidewalls that define a channel that receives an end of the crossbar. Also beneficially, the shared locking feature includes a second vertically orientated extension member which forms a second vertical guide and which is attached to the second side, wherein the crossbar also moves along the second vertical guide.

The shared locking feature can further include a retaining feature that retains the crossbar in the open position. Preferably that retaining feature includes an aligned pair of holes through the sidewalls and a pin that is inserted through the aligned pair of holes.

In practice, a crossbar support that is attached to the base member, is also included. The crossbar support has support walls that form a channel for supporting and positioning the crossbar relative to the first latch and to the second latch such that the first latch and the second latch are locked closed when the crossbar is located in the channel. In practice, the crossbar support includes a crossbar hole through the crossbar and an aligned pair of support holes through the support walls. The crossbar hole and the support holes align when the crossbar is in the closed position such that the crossbar can be locked by passing an external element through the aligned holes.

The harness rack may further include a mounting feature for attaching the harness rack to a wall.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
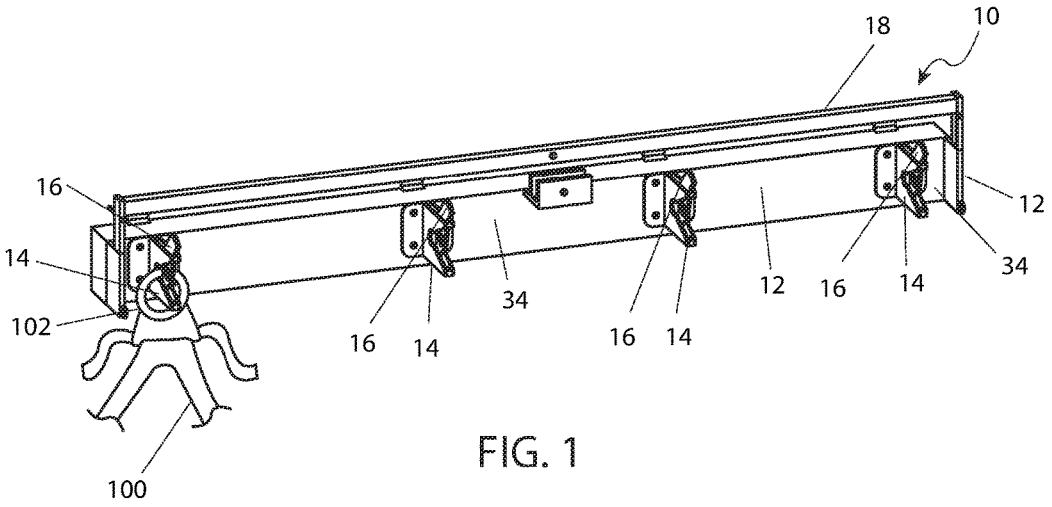
FIG. 1 is front view of a harness rack that is in accord with the present invention.

10 harness rack
12 base member
14 latch
16 individual locking feature
18 shared locking feature
20 catch
22 circular opening
24 lever
26 mounting bracket
27 flat bottom
28 lock hole
29 extending arm
31 "V" opening
33 gap
34 front face
36 mounting feature
38 extension member
40 guide
42 crossbar
44 crossbar support
46 crossbar hole
48 support hole
50 sidewall
52 channel
54 pin hole
56 pin
58 directional arrow
60 retaining feature
63 pivot
67 channel
100 safety harness
102 attachment ring

DETAILED DESCRIPTION OF THE PREFERRED EMBODIMENT

The preferred embodiment of the present invention is depicted in FIGS. 1 through 5. However, the invention is not limited to the specifically described embodiments. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one (1) of the referenced items. In addition, unless otherwise denoted all directional signals such as in, out, up, down, left, and right are taken with respect to reference to FIG. 1.

FIGS. 1 through 5 present a harness rack with locking features (hereinafter harness rack 10) that is useful for securing, organizing and storing a plurality of safety harnesses 100 (see FIG. 1). Examples of such safety harnesses 100 include, but are not limited to: full body harnesses, over the shoulder harnesses, fall protection harnesses, or similar personal fall-arresting harnesses.

FIG. 1 schematically illustrates the front view of a harness rack 10. The harness rack 10 includes a base member 12 having a plurality of latches 14. Each latch 14 is for holding or otherwise retaining one (1) safety harness 100. Each latch 14 implements an individual locking feature 16 that prevents unauthorized removal of the safety harness 100 that the latch 14 holds. The individual locking features 16 are designed to prevent the individual latches 14 from opening. The harness rack 10 also includes a shared locking feature 18 that locks all of the latches 14 at once so as to prevent them all from opening. While FIG. 1 shows four (4) latches 14 a given harness rack 10 may include less than or more than four (4) latches 14.

Figure 2:
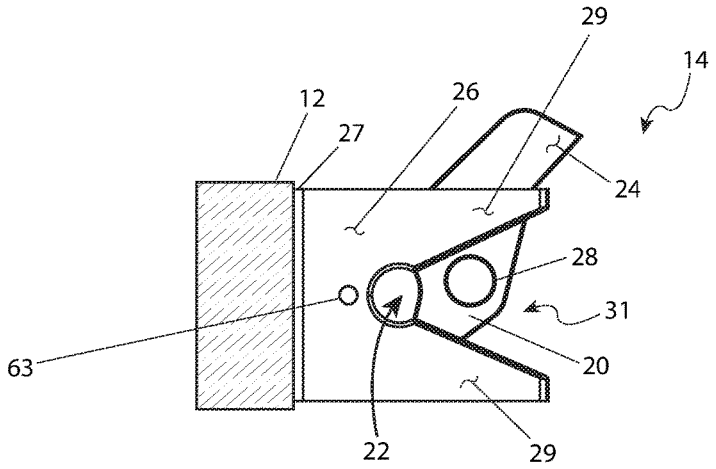
FIG. 2 is a side view of a latch and individual locking feature of the harness rack depicted in FIG. 1.

FIG. 2 schematically illustrates a side view of a latch 14 and its associated individual locking feature 16. In use, the latch 14 retains a safety harness 100 by using its associated individual locking feature 16 to lock a harness attachment ring 102 (see FIG. 1) within the latch 14. A typical harness attachment ring 102 will be an O-ring or a D-ring that is permanently attached to a safety harness 100 by passing through a loop or harness feature of the safety harness 100.

Each latch 14 and its associated individual locking feature 16 includes a mounting bracket 26 having a flat bottom 27. That flat bottom 27 is connected to the base member 12 using any suitable attachment mechanism such as mechanical fasteners, like screws or bolts, or by welding. Each mounting bracket 26 also includes two (2) extending arms 29 that extend perpendicularly from the flat bottom 27. The two (2) extending arms 29 extend to form a gap 33 (see FIG. 3) between them. The ends of the extending arms 29 also form a horizontally orientated "V" opening 31 that extends from a generally circular opening 22.

Each latch 14 and individual locking feature 16 also includes a pivoting catch 20 that is located in an associated gap. The catches 20 are attached to the extending arms 29 by pivots 63 which are located behind the circular openings 22. The lower end of each catch 20 forms hooks around part of a circular opening 22. When an attachment ring 102 is moved into the "V" opening the attachment ring 102 engages with a catch 20 which causes that catch 20 to pivot on its pivot 63 such that the attachment ring 102 can enter into the circular opening 22. When the attachment ring 102 is fully seated within the circular opening 22 the catch 20 closes and its hooking captures the attachment ring 102 and retains it in the circular opening 22.

The catch 20 also includes a lever 24 for enabling a user to pivot the catch 20 open. The lever 24 provides sufficient mass to bias the catch 20 closed such that the catch 20 automatically closes the circular opening 22 and locks an attachment ring 102 in the circular opening 22. When the lever 24 opens it pivots the catch 20 away from the circular opening 22, thereby opening the latch 14. While FIG. 2 shows the lever 24 pivoting counter-clockwise to open the circular opening 22 other arrangements are possible. In addition, instead of using gravity to bias the catch 20 toward the circular opening 22 other biasing arrangements such as springs may be used.

The individual locking feature 16 further includes a lock hole 28 through the catch 20 which is located between the elongated arms 29. The lock hole 28 is configured to receive a padlock are other locking mechanism (not shown) that when inserted through the lock hole 28 prevents the catch 20 from opening. Thus, the individual locking feature 16 can prevent its associated lever 24 from being pivoted open, thus preventing unauthorized removal of the safety harness 100. As another example, the lock hole 28 might be located through the lever 24 either above or below the catch 20. Again, the catch 20 is secured closed when a padlock bail prevents the lever 24 from pivoting open.

Figure 3:
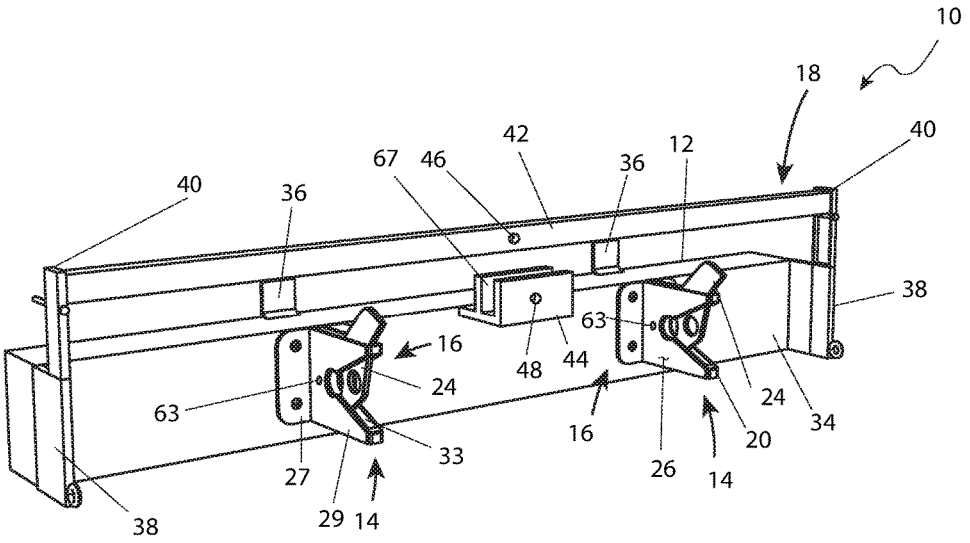
FIG. 3 is a front perspective view of the disclosed harness rack depicted in FIG. 1.

FIG. 3 presents a more detailed schematic illustration of a harness rack 10. The base member 12 is beneficially a rectangular elongated member that receives the latches 14. FIG. 3 shows mounting features 36 that may be used to attach the base member 12 to a wall or other support structure. For example, the mounting features 36 may connect the base member 12, and thus the harness rack 10, horizontally to a wall.

Figure 4:
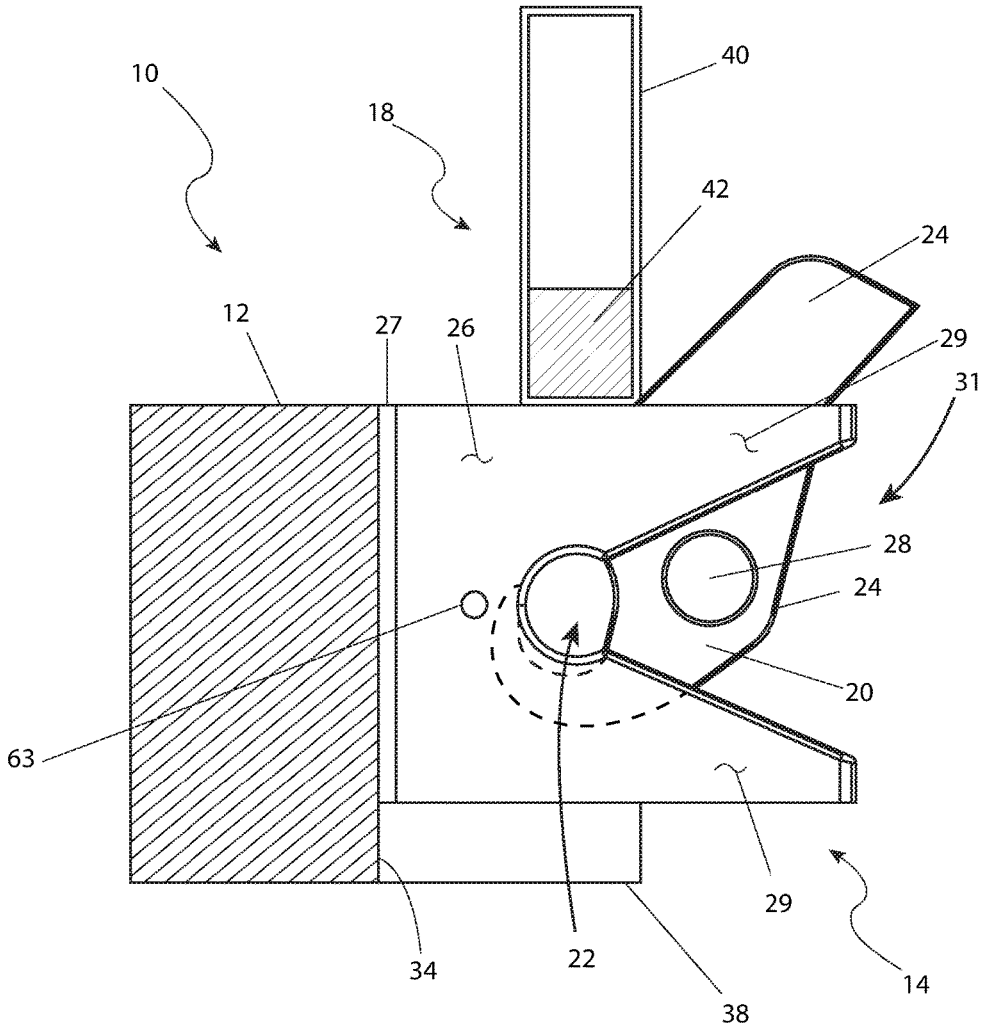
FIG. 4 is a partial cross section side view of the harness rack Illustrated in FIG. 3; and, FIG. 5 is a partial side perspective view of a guide and crossbar of the harness rack depicted in FIG. 4.

Referring now to both FIG. 3 and to the partial cross-sectional view of the harness rack 10 shown in FIG. 4, the harness rack 10 further includes a shared locking feature 18 that moves between an open position (as shown in FIG. 3) to a closed position (as shown in FIG. 4). When in the closed position the shared locking feature 18 simultaneously prevents all of the latches 14 from opening. The shared locking feature 18 includes a crossbar 42 and vertical guides 40 formed by extension members 38. The crossbar 42 extends above the base member 12 while the extension members 38 are vertically attached to the ends of the base member 12.

When the shared locking feature 18 is in the open position the crossbar 42 is based above the latches 14 such that the levers 24 are free to pivot open. When the shared locking feature 18 is in the closed position the cross bar 42 engages the upper ends of the catches 20, thus preventing the levers 24 from opening the catch. This prevents unauthorized removal of all safety harnesses 100 held by the latches 14.

The shared locking feature 18 is retained by the guides 40 that are formed by the extension members 38. The guides 40 both secure the crossbar 42 in the open position (as shown in FIG. 3) and guide the crossbar 42 into the closed position (as shown in FIG. 4). A first end of the crossbar 42 is received and moves (e.g., upward and downward) within a first guide 40 and the second end of the crossbar 42 is received and moves (e.g., upward and downward) within the second guide 40.

Figure 5:
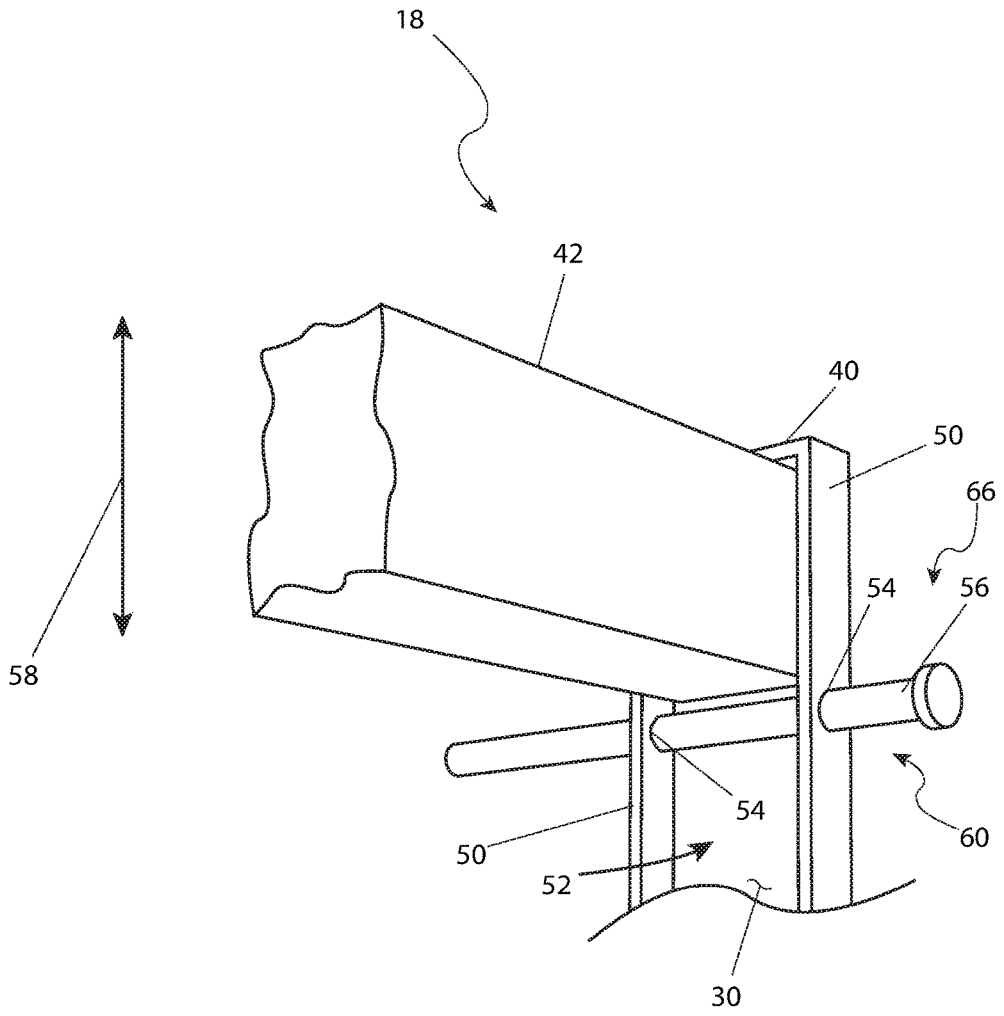

FIG. 5 presents a partial perspective view of one (1) of the guides 40. The guide 40 is formed by sidewalls 50 of an extension member 38 so as to define a channel 52. That channel 52 receives an end of the crossbar 42. The channel 52 has any suitable shape (e.g., cross-sectional shape) that corresponds to the shape of the crossbar 42. As an example, and as illustrated in FIG. 5, the channel 52 has a rectangular (including square) cross-section that corresponds to a rectangular cross-sectional shape of the crossbar 42.

The guides 40 guide the crossbar 42 between the open position (see FIG. 3) and the closed position (see FIG. 4). The crossbar 42 may move upward in the direction of arrow 58 within the guide 40 so as to be positioned above the latches 14. The crossbar 42 may move down in the direction of arrow 58 within the guide 40 to contact the latches 14 when closed.

The harness rack 10 also includes a retaining feature 60 that is configured to retain the crossbar 42 in the open position. The retaining feature 60 includes an aligned pair of holes 54 that are formed through the sidewalls 50. A pin 56 is inserted through the holes 54 and below the crossbar 42 to retain the crossbar 42 in the open position.

Referring now back to FIGS. 3 and 4, the extension members 38 position the guides 40 and the crossbar 42 forward of the front face 34 of the base member 12 such that the crossbar 42 situates over the latches 14. The harness rack 10 also includes a crossbar support 44 that is attached to the front face 34 of the base member 12. The crossbar support 44 supports and positions the crossbar 42 relative to the latches 14 when closed. The crossbar support 44 forms a channel 67 that receives, supports, and positions the crossbar 42.

The shared locking feature 18 also includes a crossbar hole 46 through the crossbar 42 and an aligned pair of support holes 48 (only one (1) support hole 48 shown in FIG. 3 because of the orientation of figure and to avoid unnecessary visual complexity) formed through the channel 67 of the crossbar support 44. The crossbar hole 46 of the crossbar 42 and the support holes 48 of the crossbar support 44 are aligned such that when the crossbar 42 is in the closed position the bail of a padlock (not shown) can pass through the crossbar hole 46 and the support holes 48 to lock the shared locking feature 18. When the shared locking feature 18 is closed and locked all of the safety harnesses 100 on the latches 14 are locked to the harness rack 10.

Other configurations of the shared locking feature 18 are also contemplated. For example, the harness rack 10 may have only one (1) extension member 38 and guide 40 at one (1) end of the base member 12. In that case (1) end of the crossbar 42 is pivotably connected such that the crossbar 42 may pivot from an approximately vertical orientation into contact with the crossbar support 44. As another example, the crossbar 42 may be located below the latches 14 and may move upward to lock the latches 14.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A harness rack, comprising:

an elongated base member having a front, a first side, and a second side;

a first latch attached to said elongated base member for holding a first ring, said first latch including a first individual locking feature for selectively preventing only said first latch from opening;

a second latch attached to said elongated base member for holding a second ring, said second latch including a second individual locking feature for selectively preventing only said second latch from opening;

a shared locking feature extending from said elongated base member for selectively preventing both said first latch and said second latch from opening; wherein said shared locking feature includes a first vertically orientated extension member attached to said first side which forms a first vertical guide and a crossbar that moves along said first vertical guide between an open position wherein said crossbar allows said first latch and said second latch to open and a closed position wherein said crossbar prevents said first latch and said second latch from opening;

a retaining feature that retains said sidewalls in said open position, said retaining feature includes an aligned pair of holes through said side-walls and a pin inserted through said aligned pair of holes; and a crossbar support attached to said base member, said crossbar support having support walls that form a channel for supporting and positioning said crossbar relative to said first latch and to said second latch such that said first latch and said second latch are locked closed when said crossbar is in said channel.

2. The harness rack recited in claim 1, wherein said shared locking feature extends from said first side and from said second side.

3. The harness rack recited in claim 1, wherein said first ring is an attachment to a safety harness.

4. The harness rack recited in claim 1, wherein said first ring is an O-shaped ring.

5. The harness rack recited in claim 1, wherein said first latch includes a mounting bracket having a flat bottom connected to said base member and two arms that extend perpendicularly from said flat bottom.

6. The harness rack recited in claim 5, wherein said two arms have a gap between them and wherein said two arms form a "V"-shaped opening that extends from a circular opening.

7. The harness rack recited in claim 6, further including a catch located in said gap, said catch for selectively capturing the first ring and for retaining the first ring in said circular opening.

8. The harness rack recited in claim 7, further comprising a pivot located behind said circular opening and attached to said catch, said pivot for enabling said catch to pivot open to enable the first ring to enter into said circular opening by passing through said V-shaped opening.

9. The harness rack recited in claim 8, wherein said catch includes a lever for enabling a user to pivot said catch open.

10. The harness rack recited in claim 8, wherein said lever biases said catch closed.

11. The harness rack recited in claim 8, wherein said catch is adapted to hook the first ring and is adapted to retain it in the circular opening.

12. The harness rack recited in claim 11, wherein said catch further comprising a lock hole for receiving a locking mechanism that when inserted through the lock hole prevents the catch from opening.

13. The harness rack recited in claim 1, wherein said first vertical guide is formed by a plurality of sidewalls that define a channel that receives an end of said crossbar.

14. The harness rack recited in claim 13, further comprising a second vertically orientated extension member which forms a second vertical guide and which is attached to said second side, wherein said crossbar moves along said second vertical guide.

15. The harness rack recited in claim 1, further comprising a mounting feature for attaching said harness rack to a wall.

16. The harness rack recited in claim 1, said crossbar support includes a crossbar hole through said crossbar and an aligned pair of support holes through said support walls, wherein said crossbar hole and said support holes align when said crossbar is in said closed position such that said crossbar is locked by passing an external element through said aligned holes.

* * * * *